United States Patent [19]

Hallenbeck et al.

[11] 4,022,052

[45] May 10, 1977

[54] STAMPING PRESS WITH AUGMENTED POWER STROKE

[75] Inventors: Norman P. Hallenbeck, Vernon; Stephen F. Willard, Andover, both of Conn.

[73] Assignee: Hallenbeck Sales Co., Inc., Vernon, Conn.

[22] Filed: May 13, 1976

[21] Appl. No.: 686,000

[52] U.S. Cl. ..... 72/429; 72/453.03; 100/266; 100/278

[51] Int. Cl.[2] ..... B21J 9/18

[58] Field of Search ..... 72/429, 453.03, 453.02, 72/445; 100/266, 278

[56] References Cited

UNITED STATES PATENTS

| | | | |
|---|---|---|---|
| 908,616 | 1/1909 | Sheppard | 100/266 |
| 3,216,234 | 11/1965 | Mitchell | 72/453.03 |
| 3,528,366 | 9/1970 | Neuenburg | 100/278 |

FOREIGN PATENTS OR APPLICATIONS

| | | | |
|---|---|---|---|
| 914,810 | 7/1954 | Germany | 72/453 |
| 427,999 | 2/1947 | Italy | 100/266 |

*Primary Examiner*—C.W. Lanham
*Assistant Examiner*—Gene P. Crosby

[57] ABSTRACT

A stamping press with an augmented power stroke has a support with a guide portion in which is slidably seated a ram having an elongated passage therein parallel to the axis of movement thereof and a head portion at one end for mounting tooling thereon. A plurality of pulley members are spaced equiangularly about and secured to the other end of the ram with the rotational axes thereof being perpendicular to the axis of movement of the ram. A piston is slidably seated in the passage in the ram and is driven in reciprocating movement by an air cylinder operatively connected to the end thereof adjacent the pulley members. Chain members equal in number to the pulley members are connected at one end to the aforementioned end of the piston and at the other end to the support at a point spaced axially of the ram from the pulley members toward the head portion thereof, each chain member extending intermediate its length about one of the pulley members.

5 Claims, 4 Drawing Figures

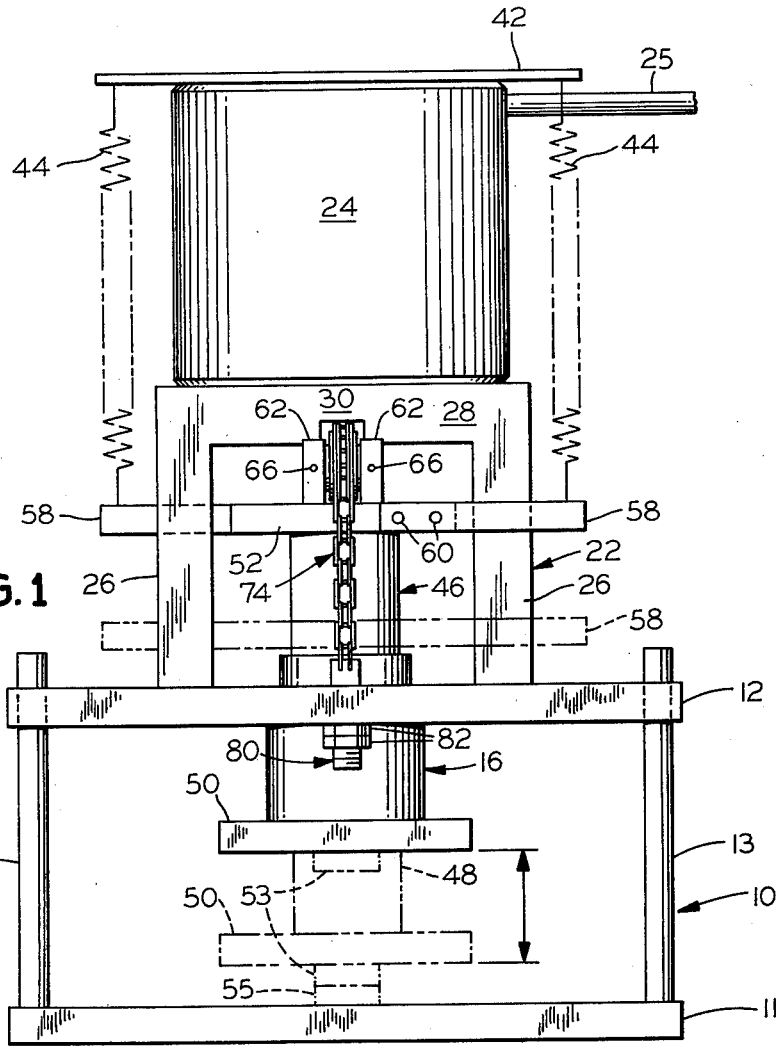
FIG. 1
FIG. 2
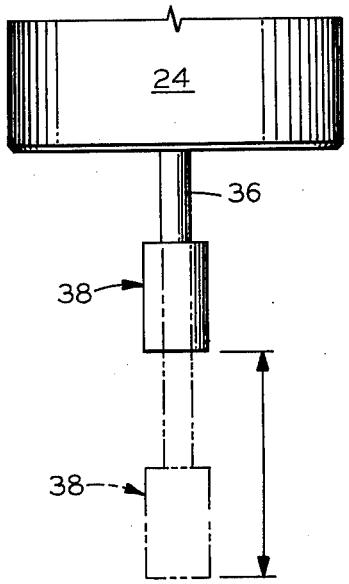

STAMPING PRESS WITH AUGMENTED POWER STROKE

BACKGROUND OF THE INVENTION

Stamping presses frequently comprise a ram operatively connected to an in-line air cylinder whereby the force applied by the ram to a work piece is equal to the force exerted on the ram by the driving cylinder. Thus to increase the force applied during the power stroke it is generally necessary to increase the size of the air cylinder or utilize, for example, auxiliary mechanical means, the latter decreasing the smoothness of press operation with corresponding diminished repeatability. Since it is less costly to manufacture air cylinders having longer strokes than to manufacture larger cylinders, it is desirable to provide an air driven stamping press utilizing a longer stroke to increase the applied pressure.

Various types of drive mechanisms provide a power stroke where the applied pressure increases to a maximum near the end of the stroke. However, for hot stamping and other applications it is desirable to maintain a relatively constant applied pressure throughout the stroke while also having the capability of high pressure operation without loss of repeatability.

Accordingly, it is an object of the present invention to provide a novel stamping press having a highly repeatable power stroke and exerting a force increased over that provided by the direct drive means for the press.

It is also an object of the present invention to provide such a press which utilizes pulley means having a mechanical advantage to increase the force exerted by piston/cylinder to augment the power stroke.

Another object is to provide such a press which utilizes an air cylinder having an increased stroke to augment the power stroke and which delivers a constant pressure throughout the stroke.

SUMMARY OF THE INVENTION

It has now been found that the foregoing and related objects of the present invention are readily attained in a stamping press with an augmented power stroke comprising a support having a guide portion and a ram slidably seated in the guide portion for movement between first and second positions. The ram has an elongated passage therein extending parallel to the axis of movement thereof and a head portion at one end thereof adapted for mounting tool means thereon, the head portion being spaced from a work piece when the ram is in the first position thereof and being spaced adjacent the work piece in the second position. The ram has rotatable means on the other end thereof the axis of rotation of which is generally perpendicular to the direction of movement of the ram. A piston is slidably seated in the passage of the ram and has drive means operatively connected to the end thereof adjacent the other end of the ram for reciprocation of the piston in the ram. Elongated flexible connector means is connected at one end to the end of the piston and at the other end to the support at a point spaced axially of the ram from the rotatable means towards the head portion thereof, the connector means extending about the rotatable means intermediate the length thereof whereby movement of the piston within the ram toward the head portion thereof simultaneously effects movement of the ram from the first to the second positions thereof. Means are provided for returning the ram from the second to the first positions thereof.

In the preferred embodiment, the rotatable means comprises a plurality of pulley members spaced generally equiangularly about the passage of the ram and the connector means comprises a plurality of chain members equal in number to the pulley members, each chain member extending about one of the pulley members. The drive means preferably comprises an air cylinder.

BRIEF DESCRIPTION OF THE DRAWINGS

FIG. 1 is a front elevational view of a stamping press embodying the present invention with the tool and die members and the extended position of the ram assembly being shown in phantom line;

FIG. 2 is a fragmentary elevational view of the cylinder and piston of FIG. 1 drawn to an enlarged scale and with the piston shown in the extended position in phantom line;

DETAILED DESCRIPTION OF THE ILLUSTRATED EMBODIMENT

Figure 3:
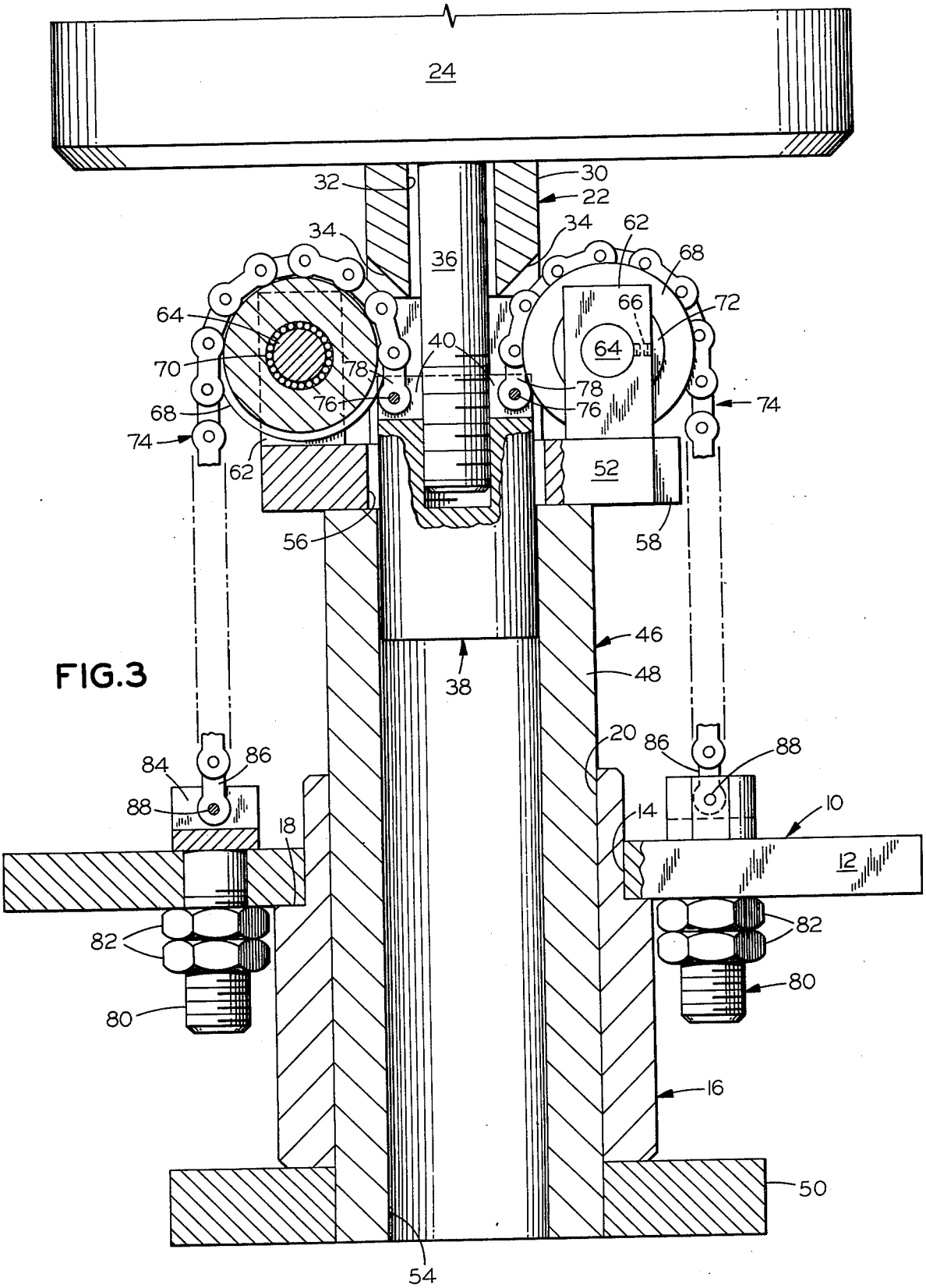
FIG. 3 is a fragmentary side elevational view of the press drawn to an enlarged scale with portions thereof broken away to illustrate internal structure and with the piston and ram assembly in the elevated position.

Turning now to FIG. 1 of the attached drawings in detail, illustrated therein is a stamping press with an augmented power stroke embodying the present invention and having a stationary support generally designated by the numeral 10 which includes a rectangular base member 11 with a rectangular plate member 12 supported in spaced relation thereabove by a pair of posts 13. The plate member 12 has a circular aperture 14 in which is secured a guide member or bushing generally designated by the numeral 16 of circular cross section, the upper end portion of the guide member 16 having a reduced external diameter to provide a shoulder 18 intermediate the length thereof which abuts the lower surface of the plate member 12. The guide member 16 has an axial bore or passage 20 of circular cross section extending therethrough for a purpose described hereinafter.

Figure 4:
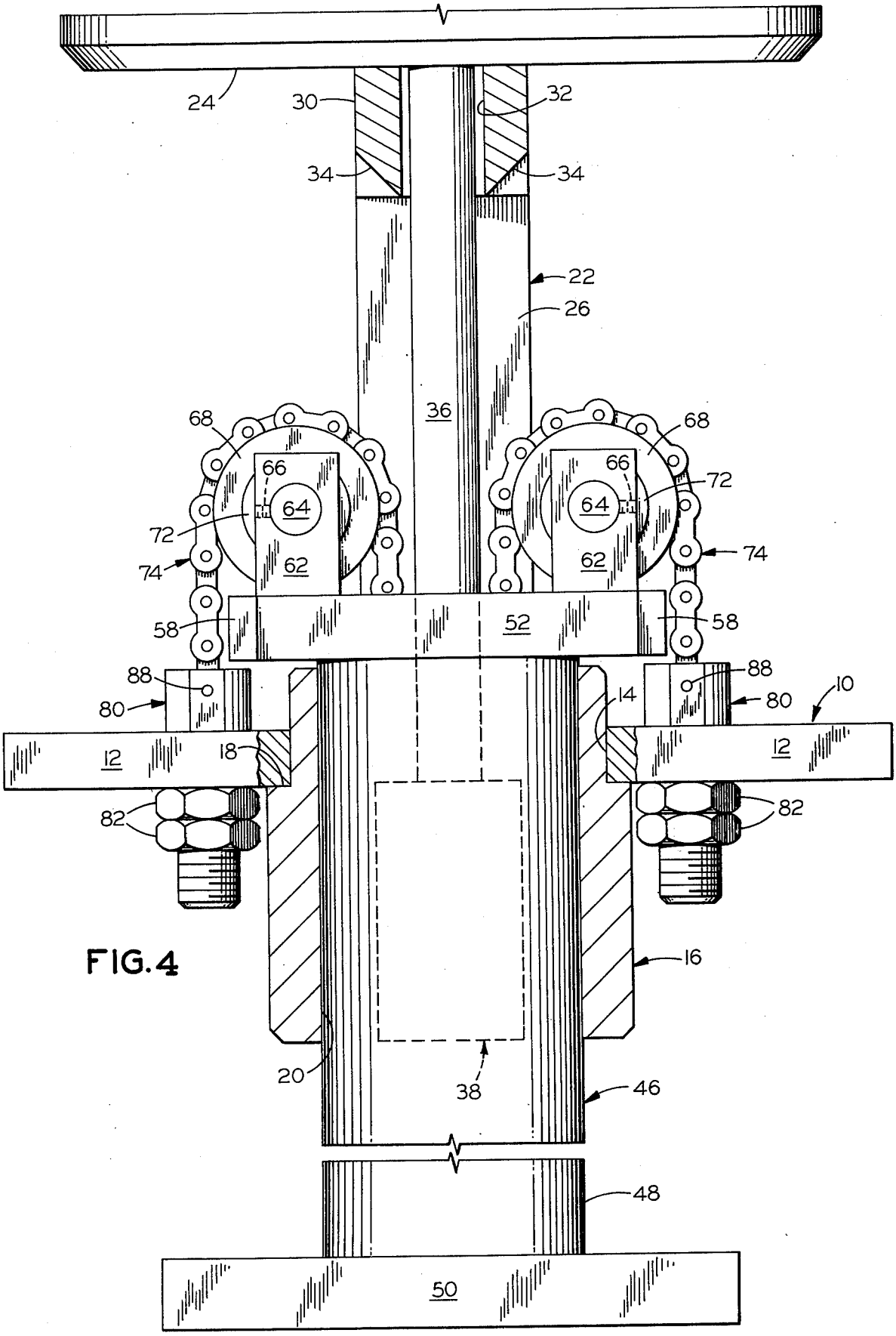
FIG. 4 is a view similar to FIG. 3 with portions of the press shown in dotted line and portions in vertical section to illustrate internal structure and with the piston and ram assembly in the extended position.

The support 10 also includes an inverted U-shaped mounting member generally designated by the numeral 22 which has its legs 26 secured to and extending upwardly from the plate member 12 to provide a base for an air cylinder 24 mounted thereon. The horizontal web 28 has secured thereto an air cylinder 24 and also has a transverse channel opening towards the plate member 12 to provide a portion 30 of lesser vertical dimension and a passage 32 therethrough coaxially with the air cylinder 24. As best seen in FIGS. 3 and 4, the lower sidewall portions 34 of the web 28 adjacent the portion 30 taper downwardly and inwardly for a purpose described hereinafter.

The air cylinder 24 has a piston (not shown) housed therewithin which is driven in reciprocating movement by pressurized air supplied thereto from an external source through the diagrammatically illustrated conduit 25. Secured to the piston within the air cylinder 24 is a piston rod 36 which extends from the cylinder 24 through the passage 32 into threaded engagement with a cylindrical piston or drive member generally designated by the numeral 38, which has a pair of diametrically extending grooves 40 (only one is shown in FIG. 3) in the upper surface thereof for a purpose described hereinafter. Thus, the piston 38 is driven directly by the air cylinder 24 and is capable of exerting a downward force equal to that provided upon the piston rod 36 by the cylinder 24. The piston 38 in turn drives a ram assembly generally designated by the numeral 46.

The ram assembly 46 includes a cylindrical sleeve 48 which is slidably seated in the bore 20 through the guide member 16. A rectangular head member 50 extends about and is secured to the lower end portion of the cylindrical sleeve 48, and a square collar member 52 is secured to the upper end thereof. As shown in FIG. 1, suitable tooling 53 is secured to the underside of the head member 50 for cooperation with die means 55 mounted on the base member 11 to shape a work piece (not shown). In hot stamping applications the positions of the tooling 53 and die means 55 are reversed.

Turning to the ram assembly 46 in more detail, as shown in FIG. 3 the cylindrical sleeve 48 has a circular bore 54 therethrough and the collar member 52 has a circular aperture 56 therethrough coaxial with and slightly larger than the passage 54, the piston rod 36 and piston 38 extending through the aperture 56 and slidably seated within the passage 54.

The collar member 52 of the ram assembly 46 has a pair of horizontally extending bar members 58 secured to opposite vertical edge surfaces thereof by fasteners 60 and projecting outwardly beyond the vertical legs 26 of the mounting member 22 diametrically of the sleeve 48. Extending between the bar members 58 and elongated bar 42 on the top surface of the air cylinder 24 are springs 44 which bias the ram assembly 46 upwardly.

Two pairs of support blocks 62 are mounted on the upper surface of the collar member 52 adjacent opposite edges thereof and each pair of blocks 62 supports a horizontal shaft 64 extending therebetween and secured thereto by set screws 66 extending inwardly of the blocks 62 into engagement with the shaft 64. A pulley member 68 is rotatably mounted on each shaft 64 intermediate the blocks 62 by bearings 70 and washers 72 are disposed on opposite sides of each pulley member 68 intermediate the blocks 62 and pulley member 68.

The piston 38 and ram assembly 46 are operatively connected by a pair of flat link pitch chains generally designated by the numeral 74 which are connected to the upper portion of the piston 38, pass over the pulley members 68, and are anchored to the plate member 12 on opposite sides of the ram assembly 46. As shown best in FIG. 3, the portion 30 of the mounting member 22 and tapered sidewall portions 34 thereof provide clearance for the chains 74 when the piston 38 and ram assembly 46 are in the uppermost positions thereof.

Each chain 74 is secured to the piston 38 by pins 76 extending horizontally through the top portions thereof at the grooves 40 and through apertures in end links 78 the spaced elements of which are seated in the parallel grooves 40. The chains 74 are secured to the plate member 12 by threaded fasteners generally designated by the numerical 80 which are retained in position by nuts 82. Each fastener 80 has a pair of parallel vertical grooves 84 (only one is shown in FIG. 3) in the head thereof in which are seated the spaced elements of end links 86, pins 88 extending through the heads of the fasteners 80 and links 86 to secure the chains 74 to the fasteners 80.

The operation of the present invention will now be described, it being understood that whatever tooling 53 and die means 55 are desired may be affixed to the head member 50 of the ram assembly 46 and base member 11. As the air cylinder 24 drives the rod 36 and piston 38 downwardly, the chains 74 are drawn therewith and simultaneously effect downward movement of the ram assembly 46. Since the pulley members 68 are moveable in a direction parallel to movement of the piston rod 36 and the force exerted thereon by the air cylinder 24, the effective force driving the ram assembly 46 is double that provided by the air cylinder 24. Correspondingly, as shown in FIGS. 1 and 2, the vertical travel of the piston rod 36 is double that of the ram assembly 46, and the sleeve portion 48 of the ram assembly 46 must have a length sufficient to accommodate the movement of the piston rod 36 and piston 38. When the downward movement of the piston rod 36 is terminated and is moved upwardly by the air cylinder 24, the springs 44 pull the ram assembly 46 upwardly from the work piece (not shown) until the head member 50 thereof abuts the bottom edge of the guide member 16.

The piston and ram assemblies are preferably operatively connected by chains extending about pulley members as illustrated, although this connection may be accomplished in other ways so long as the mechanical advantage is retained. For example, the chains may extend about sprocket wheels or shafts rotatably mounted in the support blocks. Furthermore, cables or other flexible connectors of sufficient strength may be substituted for the chains. More than two pulley members and chains may be used so long as they are disposed symmetrically about the ram assembly so that the load thereon is evenly distributed.

The preferred means for effecting reciprocation of the piston is a conventional air cylinder, although virtually any device capable of driving the drive member in the ram assembly in this manner may be used with the result that the force exerted by the ram assembly is double that exerted on the drive member.

For applications which require relatively low pressure, high repeatability operation the piston and ram assembly may be directly coupled so as to move as a unit, thus eliminating the mechanical advantage provided by the pulley assembly. To accomplish this coupling a rod or dowel is inserted horizontally through the sleeve portion of the ram assembly into engagement with the piston.

Thus, it can be seen that the present invention provides a novel stamping press having a highly repeatable power stroke and which is capable of exerting a force increased over that provided by the direct means for the press. The press utilizes chain/pulley means having a mechanical advantage to increase the force exerted by a piston/cylinder to augment the power stroke. Furthermore, the press is relatively simple to construct and is rugged so as to provide smooth, long lived operation.

Having thus described the invention, we claim:

1. A stamping press with an augmented power stroke comprising:

A. a support having a guide portion;

B. a ram slidably seated in said guide portion of said support for movement between first and second positions, said ram having an elongated passage therein extending parallel to the axis of movement thereof and a head portion at one end thereof adapted for mounting tool means thereon, said head portion being spaced from a work piece when said ram is in said first position thereof and being spaced adjacent the work piece in said second position;

C. rotatable means on the other end of said ram the axis of rotation thereof being generally perpendicular to the direction of movement of said ram;

D. piston means slidably seated in said passage of said ram;

E. drive means operatively connected to the end of said piston means adjacent said other end of said ram for reciprocation of said piston means in said ram;

F. elongated flexible connector means connected at one end to said end of said piston means and at the other end to said support at a point spaced axially of said ram from said rotatable means towards said head portion thereof, said connector means extending about said rotatable means intermediate the length thereof whereby movement of said piston means within said ram toward said head portion thereof simultaneously effects movement of said ram from said first to said second positions thereof; and G. means for returning said ram from said second to said first positions thereof.

2. The stamping press of claim 1 wherein said drive means comprises an air cylinder.

3. The stamping press of claim 1 wherein said connector means comprises a chain member.

4. The stamping press of claim 1 wherein said rotatable means comprises a plurality of pulley members spaced generally equiangularly about said passage of said ram and said connector means comprises a plurality of connector members equal in number to said pulley members each extending about one of said pulley members.

5. The stamping press of claim 4 wherein each of said connector members comprises a chain member.

* * * * *